United States Patent [19]

Ayyagari et al.

[11] 4,455,506

[45] Jun. 19, 1984

[54] CONTRAST ENHANCED ELECTROLUMINESCENT DEVICE

[75] Inventors: Murthy S. Ayyagari, North Reading; Martin P. Schrank, Ipswich; Richard M. Coppola, Beverly, all of Mass.

[73] Assignee: GTE Products Corporation, Stamford, Conn.

[21] Appl. No.: 262,097

[22] Filed: May 11, 1981

[51] Int. Cl.[3] ..... H01J 1/62; H01J 63/04

[52] U.S. Cl. ..... 313/506; 313/509; 313/518; 313/498; 427/66

[58] Field of Search ..... 313/463, 466, 441, 506, 313/509, 510, 517, 518, 498; 427/126.3, 66; 252/301.36, 301.4 P, 301.4 R; 204/192 P

[56] References Cited

U.S. PATENT DOCUMENTS

| | | | |
|---|---|---|---|
| 3,200,279 | 8/1965 | Westerveld et al. | 313/506 |
| 3,560,784 | 2/1971 | Steele et al. | 313/441 |
| 4,096,026 | 6/1978 | Takeuchi | 204/192 P |
| 4,312,915 | 1/1982 | Fan | 204/192 P |
| 4,326,007 | 4/1982 | Williams et al. | 427/66 |

FOREIGN PATENT DOCUMENTS

| | | | |
|---|---|---|---|
| 2039146 | 7/1980 | United Kingdom | 313/510 |

*Primary Examiner*—Eugene R. Laroche
*Assistant Examiner*—K. Wieder
*Attorney, Agent, or Firm*—William H. McNeill

[57] ABSTRACT

A contrast enhanced electroluminescent device employs a chromium oxide-chromium cermet as the contrast enhancing material.

6 Claims, 1 Drawing Figure

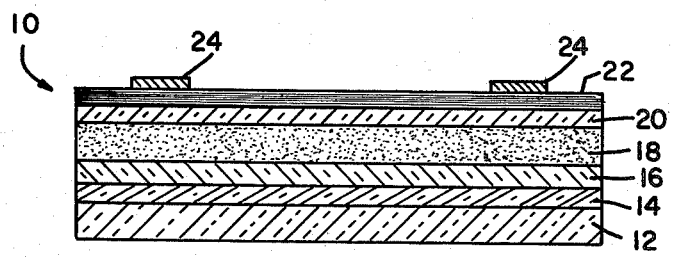
10
24
24
22
20
18
16
14
12

CONTRAST ENHANCED ELECTROLUMINESCENT DEVICE

TECHNICAL FIELD

This invention relates to electroluminescent devices and more particularly to such devices having enhanced contrast between lit and unlit portions.

BACKGROUND ART

Electroluminescent (EL) devices comprise a phosphor sandwiched between two electrodes. The phosphor can be dispersed in a dielectric medium or have dielectric layers interposed between itself and the electrodes. The phosphor is such that it will luminesce when placed in an alternating electric field. At least one of the electrodes is usually transparent to the light emitted by the phosphor. The opposite electrode can be contiguous with the entire phosphor layer, in which case a sample light source is produced, or it can be in a segmented form, such as a numeric or alpha-numeric. Such devices are known in the art. This invention concerns the latter devices. It is also known, relative to these latter devices, to employ a layer of material therewith to enhance the contrast between lit and unlit portions thereof to improve viewing under conditions of high ambient light.

U.S. Pat. No. 3,560,784, for example, discloses materials for this contrast enhancing layer as comprising sulfides, selenides and sulfoselenides (and mixtures thereof) of arsenic.

U.S. Ser. No. 974,279, filed Dec. 29, 1978 now abandoned and assigned to the assignee of the present invention, discloses a similar layer comprised of a mixture of cadmium telluride and lead telluride.

These suggested materials, however, have problems associated with their use. The arsenic compounds do not provide a satisfactory dark color and they have been known to change color with use. While the contrast enhancing layers comprised of the tellurides provide good results, cadmium telluride is a toxic material which is not recommended for industrial use.

DISCLOSURE OF THE INVENTION

It is, therefore, an object of this invention to obviate the disadvantages of the prior art.

It is another object of the invention to enhance the readability of EL devices.

These objects are accomplished, in one aspect of the invention, by the provision of an EL device including a contrast enhancing layer comprised of a cermet of chromium oxide ($Cr_2O_3$) and chromium. The preferred method of application is by sputtering from a composite target with a sputtering gas mixture of oxygen and argon.

This cermet material has good opacity and the requisite electrical resistivity to prevent cross-talk (haloing) between segments; has a low power dissipation within the layer; and, electrically, can withstand the field stresses incuded therein during operation without breakdown.

BRIEF DESCRIPTION OF THE DRAWING

The single FIGURE is a diagrammatic, sectional, elevational view of a device employing the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawing with greater particularity, there is shown an EL device 10 comprised of a transparent substrate 12 of, e.g., glass, having thereon a transparent conductive coating or layer 14. A transparent dielectric layer 16 is applied to this conductive layer 14 and is followed by a phosphor layer 18, a second transparent dielectric layer 20, the contrast enhancing layer 22 and a plurality of metal electrodes 24, which can be of any desired configuration.

The transparent conductive coating 14 can be tin oxide; the transparent dielectric layers 16 and 20 can be yttrium oxide; and the phosphor can be zinc sulfide activated by manganese. The contrast enhancing layer 22 is a cerment of chromium oxide and chromium and the electrodes 24 can be aluminum or gold or other suitable material.

The cermet layer 22 is preferably applied by sputtering from a composite target with a sputtering gas mixture of oxygen and argon. The preferred ratio of the oxygen to argon is 8:2 and the $Cr_2O_3/Cr$ target preferably contains 29% chromium by volume. A layer 22, applied as above, to thicknesses of at least 4000 Å are less than 1% transparent in the visible region of the spectrum and has an electrical resistivity of $4\times10^5$ ohm-centimeters, approximately midway of the preferred range of $10^2$ to $10^6$ ohm-centimeters.

With this layer 22 as formed as above, a device is produced which has a contrast of 2.8 when measured at an ambient light greater than 2500 foot-candles.

There is thus provided an EL device having enhanced contrast. The materials of the contrast providing layer are non-toxic and do not change color with use, thus providing an advance in the art.

While there have been shown what are at present considered to be the preferred embodiments of the invention, it will be apparent to those skilled in the art that various changes and modifications can be made herein without departing from the scope of the invention as defined by the appended claims.

We claim:

1. An electroluminescent device comprising a transparent electrode layer and a segmented electrode layer having an electroluminescent phosphor therebetween, and a contrast enhancing layer between said electroluminescent phosphor and said segmented electrode layer, said contrast enhancing layer comprising a cermet of $Cr_2O_3$ and Cr.

2. The device of claim 1 wherein said cermet has an electrical resistivity of about $4\times10^5$ ohm-centimeters.

3. The device of claim 2 wherein said cermet has a thickness of about 4000 Å.

4. The device of claim 3 wherein said cermet is applied by sputtering from a target of $Cr_2O_3$ and Cr containing about 29% Cr.

5. The device of claim 4 wherein is employed a sputtering gas mixture of oxygen and argon.

6. The device of claim 5 wherein the ratio of said oxygen to said argon is about 8.2.

* * * * *